US009868617B2

(12) United States Patent
Ikeda et al.

(10) Patent No.: US 9,868,617 B2
(45) Date of Patent: Jan. 16, 2018

(54) AUTOMATIC BOOM TELESCOPIC MOTION APPARATUS FOR WORKING MACHINE

(71) Applicant: TADANO LTD., Takamatsu-shi, Kagawa (JP)

(72) Inventors: Tomohiko Ikeda, Takamatsu (JP); Taketo Sato, Takamatsu (JP)

(73) Assignee: TADANO LTD., Takamatsu-shi (JP)

( * ) Notice: Subject to any disclaimer, the term of this patent is extended or adjusted under 35 U.S.C. 154(b) by 0 days.

(21) Appl. No.: 15/311,270

(22) PCT Filed: May 15, 2015

(86) PCT No.: PCT/JP2015/064043

§ 371 (c)(1),
(2) Date: Nov. 15, 2016

(87) PCT Pub. No.: WO2015/178312

PCT Pub. Date: Nov. 26, 2015

(65) Prior Publication Data

US 2017/0088402 A1 Mar. 30, 2017

(30) Foreign Application Priority Data

May 19, 2014 (JP) ..... 2014-103104

(51) Int. Cl.
*B66C 13/18* (2006.01)
*B66C 23/00* (2006.01)
(Continued)

(52) U.S. Cl.
CPC ..... *B66C 13/18* (2013.01); *B66C 13/20* (2013.01); *B66C 23/54* (2013.01); *B66C 23/701* (2013.01); *B66C 23/705* (2013.01); *B66C 23/42* (2013.01)

(58) Field of Classification Search
None
See application file for complete search history.

(56) References Cited

U.S. PATENT DOCUMENTS

2005/0209759 A1 9/2005 Lee
2010/0196096 A1* 8/2010 Halonen ..... E01C 19/405 404/84.1
2015/0094859 A1* 4/2015 Awerbuch ..... B23D 47/08 700/275

FOREIGN PATENT DOCUMENTS

CN 201400528 Y 2/2010
CN 203048456 U 7/2013
(Continued)

OTHER PUBLICATIONS

Aug. 18, 2015 International Search Report issued in International Patent Application No. PCT/JP2015/064043.
(Continued)

*Primary Examiner* — Jonathan M Dager
*Assistant Examiner* — Garrett F Evans
(74) *Attorney, Agent, or Firm* — Oliff PLC

(57) ABSTRACT

An automatic boom telescopic motion apparatus for a working machine includes an automatic telescopic motion part configured to continue the telescopic motion of the boom without inputting an operation to perform the telescopic motion of the boom by the boom telescopic motion input part, in a state in which the on/off operation part is turned on, when the output detection part detects an output which is equal to or greater than a predetermined value and an operation is inputted to the boom telescopic motion input part to increase the speed of the telescopic motion of the boom to a value equal to or higher than a predetermined value.

12 Claims, 6 Drawing Sheets

(51) Int. Cl.

| | |
|---|---|
| ***B66C 23/70*** | (2006.01) |
| ***B66C 13/20*** | (2006.01) |
| *B66C 23/42* | (2006.01) |

(56) References Cited

FOREIGN PATENT DOCUMENTS

| | | | |
|---|---|---|---|
| CN | 203067451 | U | 7/2013 |
| CN | 103303832 | A | 9/2013 |
| JP | H02-83887 | U | 6/1990 |
| JP | 2000-296985 | A | 10/2000 |
| JP | 2003-285990 | A | 10/2003 |
| JP | 2005-273443 | A | 10/2005 |
| JP | 2013-112437 | A | 6/2013 |

OTHER PUBLICATIONS

Aug. 25, 2017 Office Action dated Chinese Patent Application No. 201580026213.4.

* cited by examiner

AUTOMATIC BOOM TELESCOPIC MOTION APPARATUS FOR WORKING MACHINE

TECHNICAL FIELD

The present invention relates to an automatic boom telescopic motion apparatus for a working machine including a boom that performs telescopic motion.

BACKGROUND ART

Conventionally, there has been known this sort of working machine having a boom configured to perform telescopic motion, such as a mobile crane. This boom includes a plurality of boom members and performs the telescopic motion by shifting next boom members in front of respective ones with respect to the boom members other than a top boom member (see, for example, Patent Literature 1).

In addition, the boom performs the telescopic motion by driving a telescopic cylinder provided in the boom members. Therefore, if an amount of the telescopic motion is increased by, for example, extending the boom from the minimum length to the maximum length, it takes a long time for the telescopic motion of the boom.

CITATION LIST

Patent Literature

PTL1: Japanese Patent Application Laid-Open No. 2013-112437

SUMMARY OF INVENTION

Technical Problem

The above-described working machine includes: an accelerator pedal configured to input an operation for adjusting the output of an engine as a driving source of the telescopic cylinder; and a boom telescopic motion lever configured to input the direction of the telescopic motion of the boom and also input the operation for adjusting the speed of the telescopic motion. During the telescopic motion of the boom, the operator of the working machine has to keep the boom telescopic motion lever tilted while operating the accelerator pedal. Therefore, when an amount of the telescopic motion is increased, the operator of the working machine has to keep the boom telescopic motion lever tilted for a long time, and therefore the arms or hands of the operator would be strained and fatigued.

It is therefore an object of the present invention to provide an automatic boom telescopic motion apparatus for a working machine that can decrease in strain and fatigue in the arms or hands of the operator who inputs the operation for performing the telescopic motion of the boom.

Solution to Problem

To achieve the object, the automatic boom telescopic motion apparatus for a working machine include: a boom including a plurality of boom members, the boom performing telescopic motion by shifting next boom members in front of respective ones with respect to the boom members other than a top boom member; a telescopic cylinder configured to allow the boom to perform the telescopic motion; a driving source configured to drive the telescopic cylinder; an output detection part configured to detect an output of driving force supplied from the driving source; a boom telescopic motion input part configured to input a direction of the telescopic motion of the boom and also input an operation to adjust a speed of the telescopic motion of the boom; an on/off operation part configured to be able to switch between on and off by a predetermined operation; and an automatic telescopic motion part configured to continue the telescopic motion of the boom without inputting an operation to perform the telescopic motion of the boom by the boom telescopic motion input part, in a state in which the on/off operation part is turned on, when the output detection part detects an output which is equal to or greater than a predetermined value and an operation is inputted to the boom telescopic motion input part to increase the speed of the telescopic motion of the boom to a value equal to or higher than a predetermined value.

By this means, in a state in which the on/off operation part is turned on, when an operation is inputted to the output adjustment input part to increase the output of the driving source to a value equal to or greater than a predetermined value, and also an operation is inputted to the telescopic motion input part to increase the speed of the telescopic motion of the boom to a value equal to or higher than a predetermined value, it is possible to continue the telescopic motion of the boom without inputting the operation for performing the telescopic motion of the boom by the telescopic motion input part.

Effect of the Invention

According to the present invention, when an amount of the telescopic motion of the boom is increased by, for example, extending the boom from the minimum length to the maximum length, it is possible to keep the speed of the telescopic motion of the boom without the operation of the boom telescopic motion input part. Therefore, it is possible to decrease in strain and fatigue in the arms or hands of the operator when the amount of the telescopic motion of the boom is increased.

DESCRIPTION OF EMBODIMENTS

FIGS. 1 to 6 show an embodiment of the present invention. With the present embodiment, a mobile crane 1 will be described as a crane apparatus having the automatic boom telescopic motion apparatus according to the present invention.

Figure 1:
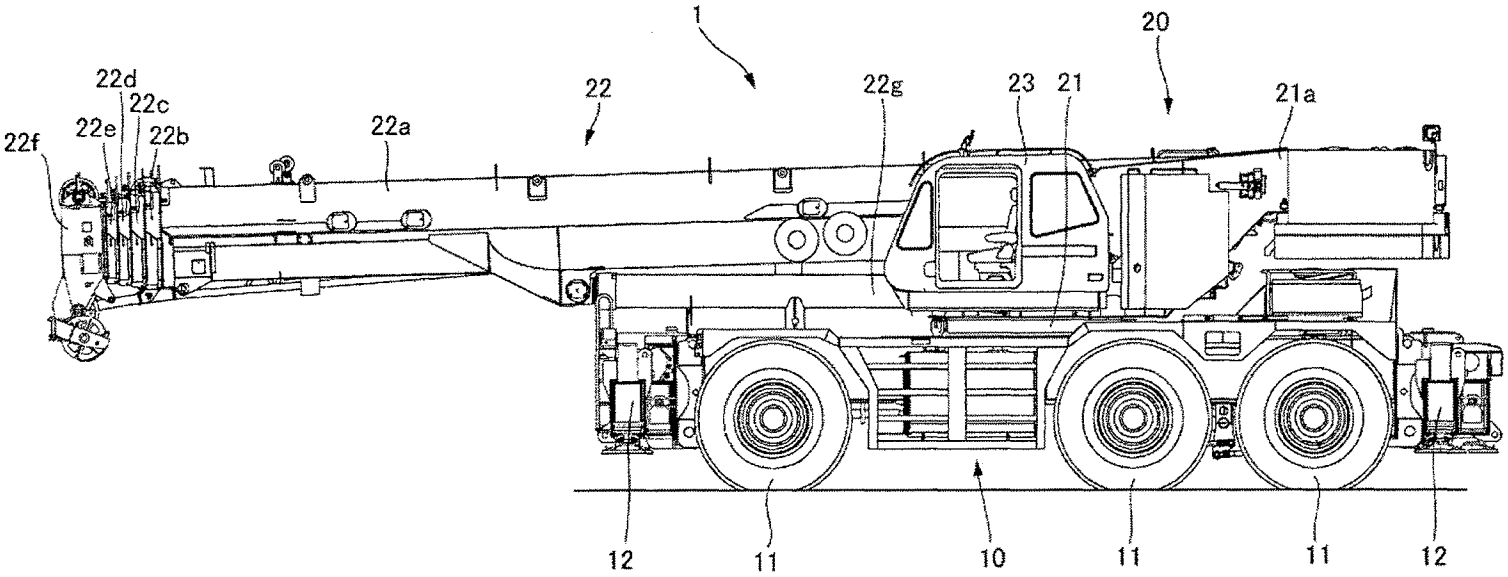
FIG. 1 is a side view showing a mobile crane according to one embodiment of the present invention.

As shown in FIG. 1, the mobile crane 1 includes a vehicle 10 that runs on the ground, and a crane apparatus 20.

The vehicle 10 has wheels 11 and runs by an engine (not shown) as a power source. In addition, outriggers 12 are provided on the right and left sides of the front part of the vehicle 10 and also on the right and left sides of the rear part of the vehicle 10 to prevent the vehicle 10 from overturning and support the vehicle 10 stably when the crane is working. Each outrigger 12 is movable outward in the width direction and also extendable downward by a hydraulic jack cylinder (not shown). The bottom ends of the outriggers 12 contact the ground to support the vehicle 10 on the ground stably.

The crane apparatus 20 includes a swivel base 21 that is pivotably provided in the center part of the vehicle 10 in the longitudinal direction and is configured to be able to swivel on a horizontal plane; a boom 22 provided to be able to rise and down with respect to the swivel base 21 and to be able to extend and contract; and a cabin 23 provided in the front part of the swivel base 21 to run the vehicle 10 and operate the crane apparatus 20 for the crane work.

The swivel base 21 is configured to be able to swivel with respect to the vehicle 10 by means of a ball bearing or roller bearing swivel support. The swivel base 21 is driven by a hydraulic swivel motor (not shown).

The boom 22 is constituted by a plurality of boom members 22*a*, 22*b*, 22*c*, 22*d*, 22*e* and 22*f* and formed as a telescopic boom in such a manner that the boom members 22*a*, 22*b*, 22*c*, 22*d*, and 22*e* can accommodate the respective next boom members 22*b*, 22*c*, 22*d*, 22*e* and 22*f* in front of the boom members 22*a*, 22*b*, 22*c*, 22*d*, and 22*e*. The boom 22 according to the preset embodiment is constituted by six boom members, the bottom boom member 22*a*, the second boom member 22*b*, the third boom member 22*c*, the fourth boom member 22*d*, the fifth boom member 22*e*, and the top boom member 22*f*, which are arranged in the order from the base end of the boom 22.

The base end of the bottom boom member 22*a* is swingably connected to a bracket 21*a* of the swivel base 21. A hydraulic luffing cylinder 22*g* is connected between the bottom boom member 22*a* and the bracket 21*a*, and extends and contracts to allow the boom 22 to rise and down.

A boom telescopic motion mechanism 30 allows the boom 22 to extend and contract.

Figure 2:
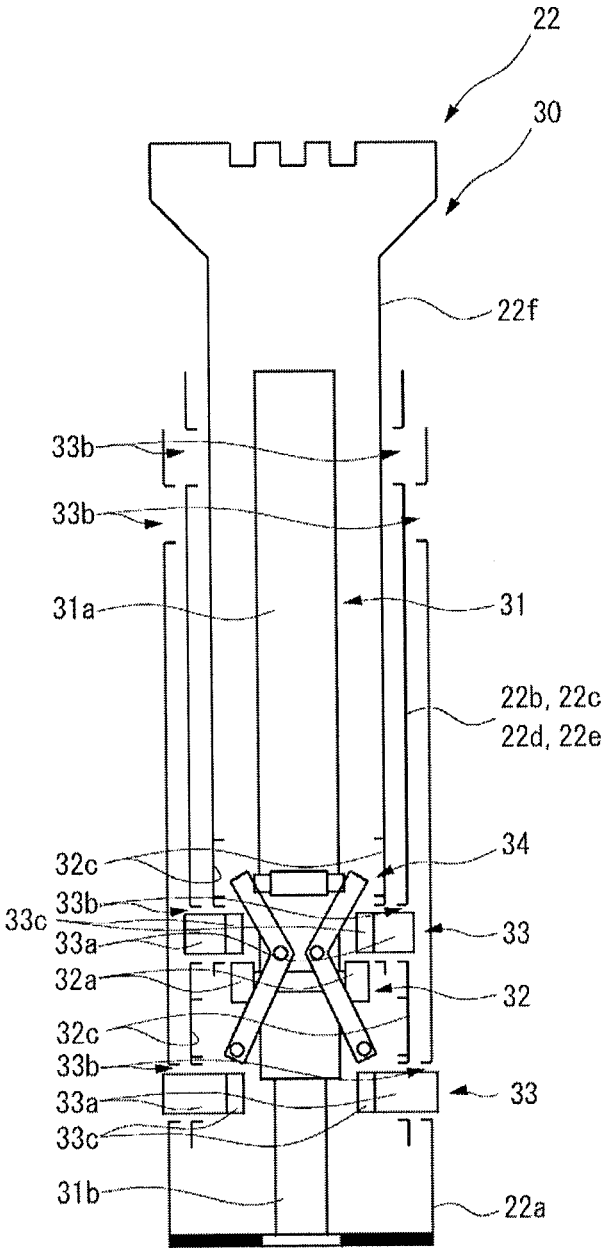
FIG. 2 is a schematic view showing a boom and a boom telescopic motion mechanism.
Figure 3:
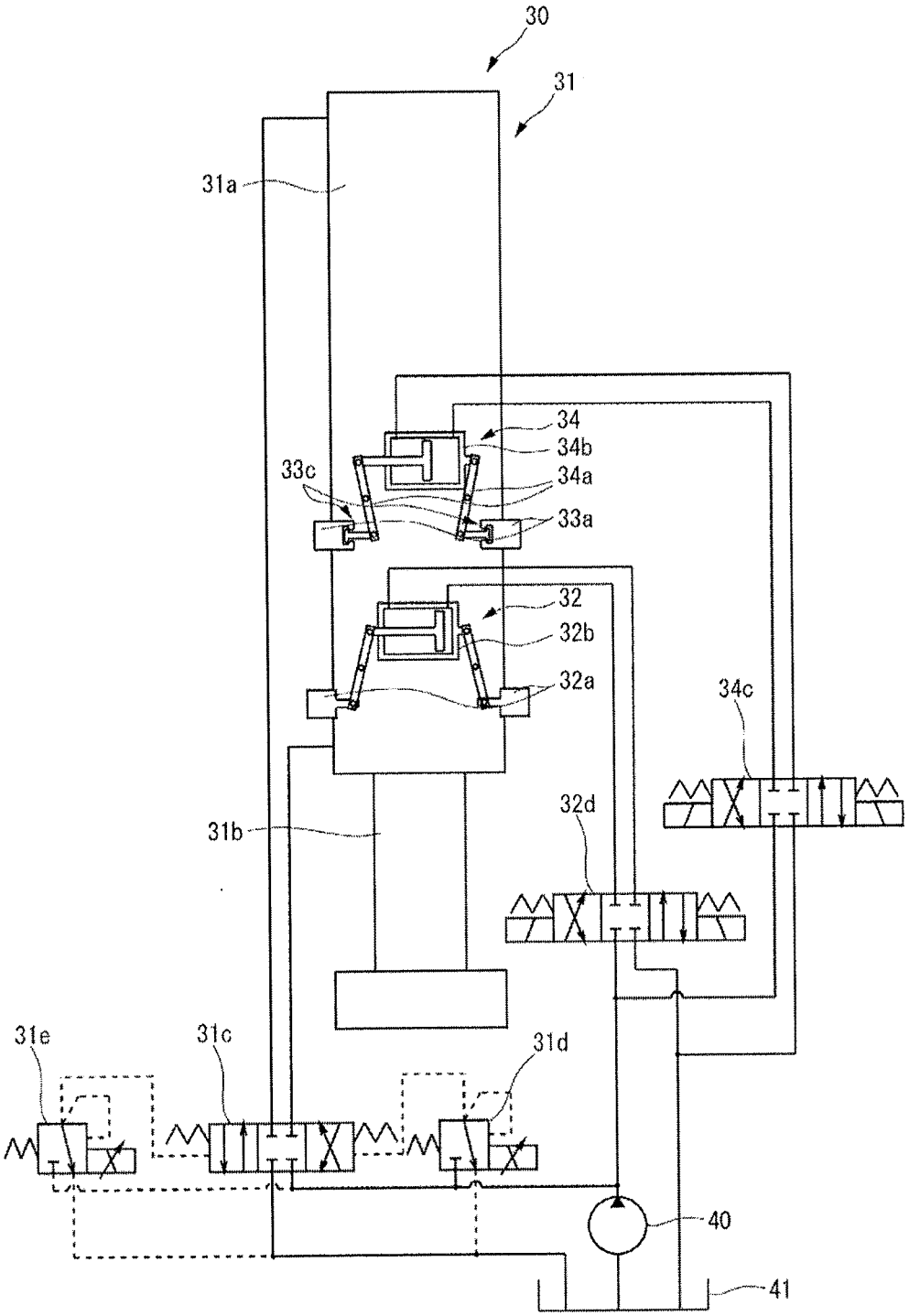
FIG. 3 is a schematic view showing the boom telescopic motion mechanism.

As shown in FIGS. 2 and 3, the boom telescopic motion mechanism 30 includes: a telescopic cylinder 31 that shifts the boom members 22*b*, 22*c*, 22*d*, 22*e* and 22*f* other than the bottom boom member 22*a*; a cylinder-to-boom connection mechanism 32 that removably connects between the telescopic cylinder 31 and the boom members 22*b*, 22*c*, 22*d*, 22*e* and 22*f* other than the bottom boom member 22*a*; a plurality of boom member connection mechanism 33 that removably connect between the boom members 22*a*, 22*b*, 22*c*, 22*d* and, 22*e* and respective next ones, the boom members 22*b*, 22*c*, 22*d*, 22*e* and 22*f* in front of the boom members 22*a*, 22*b*, 22*c*, 22*d* and 22*e*; and a boom member disconnection mechanism 34 that disconnects between the boom members 22*a*, 22*b*, 22*c*, 22*d*, and 22*e* and respective next ones, the boom members 22*b*, 22*c*, 22*d*, 22*e* and 22*f* in front of the boom members 22*a*, 22*b*, 22*c*, 22*d* and 22*e*.

As shown in FIG. 2, the telescopic cylinder 31 includes a cylinder tube 31*a* and a piston rod 31*b*. The front end of the piston rod 31*b* is connected to the base end of the bottom boom member 22*a* in the bottom boom member 22*a*. The cylinder tube 31*a* moves with respect to the piston rod 31*b* in the direction of the telescopic motion of the boom.

As shown in FIG. 3, a hydraulic pump 40 and a hydraulic oil tank 41 are connected to the telescopic cylinder 31 via a pilot type telescopic motion switching valve 31*c*. The telescopic cylinder 31 is extended by supplying hydraulic oil to the bottom side of the cylinder tube 31*a*, and is contracted by supplying the hydraulic oil to the piston rod 31*b* side of the cylinder tube 31*a*. A hydraulic oil flow path of the telescopic motion switching valve 31*c* is switched by the pilot pressure supplied from a first electromagnetic proportional valve 31*d* and a second electromagnetic proportional valve 31*e*. The first electromagnetic proportional valve 31*d* is configured to supply the pilot pressure to switch the hydraulic oil flow path of the telescopic motion switching value 31*c* in a direction to allow communication between the discharge side of the hydraulic pump 40 and the bottom side of the cylinder tube 31*a* and also communication between the piston rod 31*b* side of the cylinder tube 31*a* and the hydraulic oil tank 41. The second electromagnetic proportional valve 31*e* is configured to supply the pilot pressure to switch the hydraulic oil flow path of the telescopic motion switching value 31*c* in a direction to allow communication between the discharge side of the hydraulic pump 40 and the piston rod 31*b* side of the cylinder tube 31*a* and also communication between the bottom side of the cylinder tube 31*a* and the hydraulic oil tank 41. Each of the first electromagnetic proportional valve 31*d* and the second electromagnetic proportional valve 31*e* can change the area of the opening of the hydraulic oil flow path therein, and can gradually increase or decrease the pilot pressure to be supplied to the telescopic motion switching valve 31*c*. The telescopic motion switching valve 31*c* has the area of the opening of the hydraulic oil flow path which depends on the pilot pressures supplied from the first electromagnetic proportional valve 31*d* and the second electromagnetic proportional valve 31*e*. When the area of the opening of the hydraulic oil flow path of the telescopic motion switching valve 31*c* is increased, the speed of the telescopic motion of the telescopic cylinder 31 is increased. In contrast, when the area of the opening of the hydraulic oil flow path of the telescopic motion switching valve 31*c* is reduced, the speed of the telescopic motion of the telescopic cylinder 31 is reduced.

As shown in FIG. 3, the cylinder-to-boom connection mechanism 32 is provided on the outer periphery of the cylinder tube 31*a* of the telescopic cylinder 31. The cylinder-to-boom connection mechanism 32 includes a pair of cylinder pins 32*a* that can engage with the boom members 22*b*, 22*c*, 22*d*, 22*e* and 22*f* other than the bottom boom member 22*a*; and a cylinder-to-boom connection switching cylinder 32*b* that releases the pair of cylinder pins 32*a* from engaging with the boom members 22*b*, 22*c*, 22*d*, 22*e* and 22*f* other than the bottom boom member 22*a*.

As shown in FIG. 2, a cylinder pin engagement part 32*c* formed in a concave shape is provided in the base end side of each of the boom members 22*b*, 22*c*, 22*d*, 22*e* and 22*f* other than the bottom boom member 22*a*. The cylinder pin 32*a* can engage with each of the cylinder pin engagement part 32*c*.

The pair of cylinder pins 32*a* can move in the radial direction of the cylinder tube 31*a*. When being moved outward in the radial direction, the pair of cylinder pins 32*a* engages with the cylinder pin engagement parts 32*c*. Meanwhile, when being moved inward in the radial direction, the pair of cylinder pins 32 is released from engaging with the cylinder pin engagement parts 32*c*.

As shown in FIG. 3, the hydraulic pump 40 and the hydraulic oil tank 41 are connected to the cylinder-to-boom connection switching cylinder 32*b* via an electromagnetic type cylinder-to-boom connection switching valve 32*d*. The cylinder-to-boom connection switching cylinder 32*b* performs the telescopic motion by switching the hydraulic oil flow path of the cylinder-to-boom connection switching valve 32*d* to switch between the engagement of the cylinder pins 32*a* with the cylinder pin engagement parts 32*c* and the disengagement of the cylinder pins 32*c* with the cylinder pin engagement parts 32*c*.

As shown in FIG. 2, each of the boom member connection mechanisms 33 includes: a boom member connection pin 33*a* provided in each of the boom members 22*b*, 22*c*, 22*d*, 22*e* and 22*f* in the front end side of the boom 22; and a pin engagement hole 33*b* provided in each of the boom members 22*a*, 22*b*, 22*c*, 22*d* and 22*e* in the base end side of the boom 22, which can engage with the boom member connection pin 33*a*.

As shown in FIG. 2, the boom member connection pin 33*a* is biased in the direction in which the front end of the boom member connection pin 33*a* engages with the pin engagement hole 33*b* of the next boom member 22*a*, 22*b*, 22*c*, 22*d*, and 22*e* in the base end side. A lever engagement part 33*c* to engage with a disconnection lever 33*c* of the boom member disconnection mechanism 34 described later is provided on the boom member connection pin 33*a*.

As shown in FIG. 2, the pin engagement holes 33*b* are provided for the base end sides and front end sides of the boom members 22*a*, 22*b*, 22*c*, 22*d* and 22*e*. The pin engagement holes 33*b* are provided in positions to meet the protrusion length of the boom members 22*b*, 22*c*, 22*d*, 22*e*, and 22*f* from the respective next boom members 22*a*, 22*b*, 22*c*, 22*d*, and 22*f* in front of the boom members 22*a*, 22*b*, 22*c*, 22*d*, and 22*e*, in addition to the base end sides and front end side of the boom members 22*a*, 22*b*, 22*c*, 22*d* and 22*e*.

As shown in FIG. 3, the boom member disconnection mechanism 34 is provided on the outer periphery of the cylinder tube 31*a* of the telescopic cylinder 31, and has a disconnection lever 34*a* that can engage with the lever engagement part 33*c* for any boom member connection pin 33*a*, and a boom member connection switching cylinder 34*b* that activates the disconnection lever 34*a*.

The disconnection lever 34*a* can engage with the lever engagement part 33*c* of the boom member connection pin 33*a* at the position at which the pair of cylinder pins 32*a* engages with the cylinder pin engagement parts 32*c*. In addition, by driving the boom member connection switching cylinder 34*b*, the disconnection lever 34*a* releases the boom member connection pins 33*a* from connecting between the boom members.

As shown in FIG. 3, the hydraulic pump 40 and the hydraulic oil tank 41 are connected to the boom member connection switching cylinder 34*b* via an electromagnetic type boom member connection switching valve 34*c*. The boom member connection switching cylinder 34*b* performs the telescopic motion by switching the hydraulic oil flow path of the boom member connection switching valve 34*c*, and switches between the connection and the disconnection of the boom members 22*a*, 22*b*, 22*c*, 22*d*, 22*e* and 22*f*.

Here, a pair of hydraulic oil flow paths (not shown) between the telescopic cylinder 31 and the telescopic motion switching valve 31*c* is formed in the piston rod 31*b* of the telescopic cylinder 31 connected to the base end of the bottom boom member 22*a*. In the cylinder tube 31*a*, the pair of hydraulic oil flow paths communicates with a piston provided on the end of the piston rod 31*b* such that one of the pair of hydraulic oil flow paths communicates with the space of the piston in the piston rod 31*b* side, and the other communicates with the space of the piston in the bottom part side of the piston. The pair of hydraulic oil flow paths is provided in the piston rod 31 which does not move in the direction of the telescopic motion of the boom 22, and therefore does not influence the motion of the cylinder tube 31*a* which moves with respect to the piston rod 31*b*.

The pair of hydraulic oil flow paths between the cylinder-to-boom connection switching cylinder 32*b* and the cylinder-to-boom connection switching valve 32*d* is formed with a flexible hydraulic hose. Also, the pair of hydraulic oil flow paths between the boom member connection switching cylinder 34*b* and the boom member connection switching valve 34*c* is formed with a flexible hydraulic hose. The hydraulic hose has a length with which the hydraulic oil can be supplied to the cylinder-to-boom connection switching cylinder 32*b* and the boom member connection switching cylinder 34*b* while the telescopic cylinder 31 is maximally extended. The hydraulic hose is wound around a hose reel (not shown), and is reeled out of or reeled on the hose reel according to the telescopic motion of the telescopic cylinder 31.

The hydraulic pump 40 is driven by the power of the engine for running the vehicle 10 which is taken via a PTO mechanism. The number of revolutions of the engine for driving the hydraulic pump 40 is controlled by operating the accelerator pedal which can be operated by one of the feet of the operator sitting on the seat in the cabin 23.

The mobile crane 1 includes a controller 50 that controls the running of the vehicle 10 and the operation of the crane apparatus 20.

The controller 50 includes a CPU, a ROM, a RAM and so forth. Upon receiving an input signal from a device connected to its input side, the controller 50 reads a program stored in the ROM based on the input signal, stores a state detected according to the input signal in the RAM, and sends an output signal to a device connected to its output side.

Figure 4:
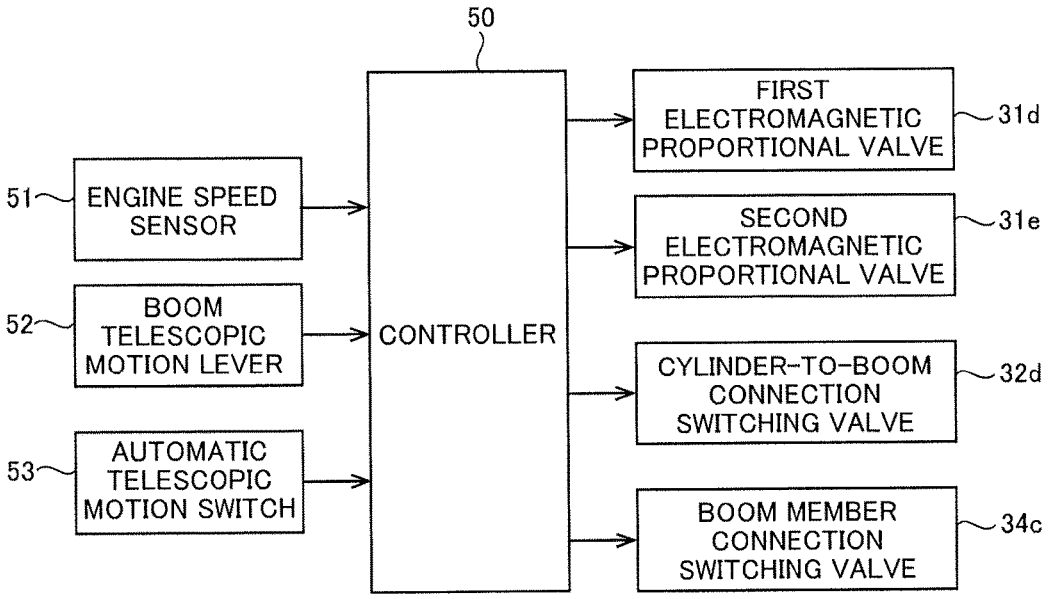
FIG. 4 is a block diagram showing a control system.
Figure 5:
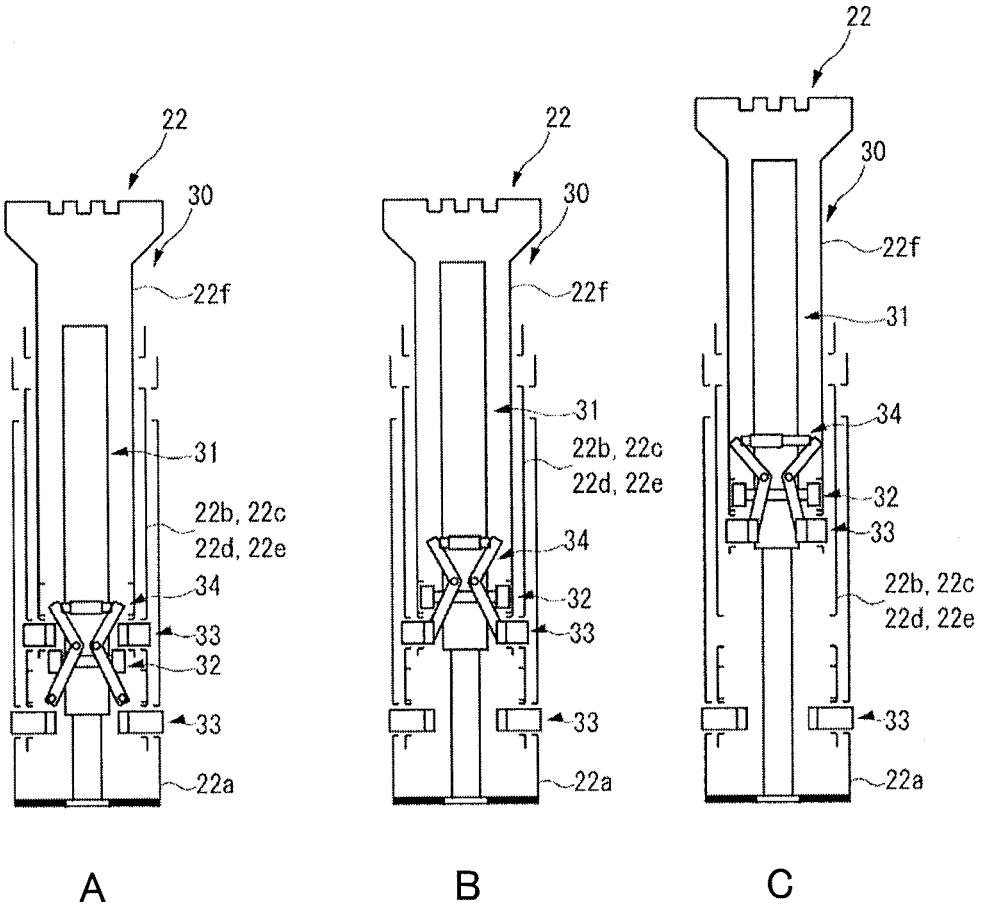
FIG. 5 is a schematic view showing the telescopic motion of the boom.

As shown in FIG. 4, an engine speed sensor 51 as an output detection part configured to detect the number of revolutions of the engine; a boom telescopic motion lever 52 as a boom telescopic motion input part configured to input an operation to perform the telescopic motion of the boom 22 by the operator; and an automatic telescopic motion switch 53 as an on/off operation part configured to turn on/off the automatic telescopic motion to continue the telescopic motion of the boom 22 without inputting the operation to the boom telescopic motion lever 52.

The boom telescopic motion lever 52 can be operated to be tilted in the front-to-back direction by the operator sitting on the seat in the cabin 23. The operator operates the boom telescopic motion lever 52 to be tilted toward the front of the vehicle 10, so that the boom 22 is extended. Meanwhile, the operator operates the boom telescopic motion lever 52 to be tilted toward the back of the vehicle 10, so that the boom 22 is contracted. The angle for which the boom telescopic motion lever 52 is tilted forward or backward corresponds to the speed of the telescopic motion of the boom 22. To be more specific, when the angle for which the boom telescopic motion lever 52 is tilted is increased, the speed of the telescopic motion is increased. Meanwhile, when the operator does not operate the boom telescopic motion lever 52 to be tilted forward or backward, the boom telescopic motion lever 52 is returned to a neutral position at an approximate center of the range for which the boom telescopic motion lever 52 is tilted forward and backward.

The automatic telescopic motion switch 53 is a button switch that can be pushed by the operator sitting on the seat in the cabin 23. The automatic telescopic motion switch 53 can switch between on and off of the automatic telescopic motion of the boom 22 every time the automatic telescopic motion switch 53 is pushed.

As shown in FIG. 4, the first electromagnetic proportional valve 31*d*, the second electromagnetic proportional valve 31*e*, the cylinder-to-boom connection switching valve 32*d*, and the boom member connection switching valve 34*c* are connected to the output side of the controller 50.

In order to extend the boom 22 of the mobile crane apparatus 1 having the above-described configuration, the boom members 22*b*, 22*c*, 22*d*, 22*e* and 22*f* accommodated in the boom members 22*a*, 22*b*, 22*c*, 22*d* and 22*e* located in the base end side, respectively, are shifted in the order from the boom member 22*f* that is located in the front end side. Meanwhile, in order to contract the boom 22, the boom members 22*b*, 22*c*, 22*d*, 22*e* and 22*f* protruding from the boom members 22*a*, 22*b*, 22*c*, 22*d* and 22*e* located in the base end side, respectively, are shifted in the order from the boom member that is located in the base end side.

In order to perform the telescopic motion of the boom 22, the boom telescopic motion mechanism 30 first drives the cylinder-to-boom connection switching cylinder 32*b* to release the cylinder pins 32*a* from engaging with the boom member and then drives the telescopic cylinder 31 (see FIG. 5A). Next, the boom telescopic motion mechanism 30 shifts the cylinder pins 32*a* to the position at which the cylinder pins 32*a* face the cylinder pin engagement parts 32*c* of the boom member intended to be shifted by driving the telescopic cylinder 31, and drives the cylinder-to-boom connection switching cylinder 32*b* to release the cylinder pins 32*a* from disconnecting from the boom member. As a result, the cylinder pins 32*a* engage with the cylinder pin engagement part 32*c* of the boom member intended to be shifted (see FIG. 5B). After the cylinder pins 32*a* are engaged with the cylinder pin engagement parts 32*c*, the boom telescopic motion mechanism 30 drives the boom member connection switching cylinder 34*b* to disconnect between the boom member to be shifted and the next boom member in the base end side. In this state, the boom telescopic motion mechanism 30 drives the telescopic cylinder 31 to allow the boom 22 to perform the telescopic motion (see FIG. 5C). After the intended boom member is shifted to a predetermined position, the boom telescopic motion mechanism 30 drives the boom member connection switching cylinder 34*b* to connect the shifted boom member to the next base member in the base end side.

Figure 6:
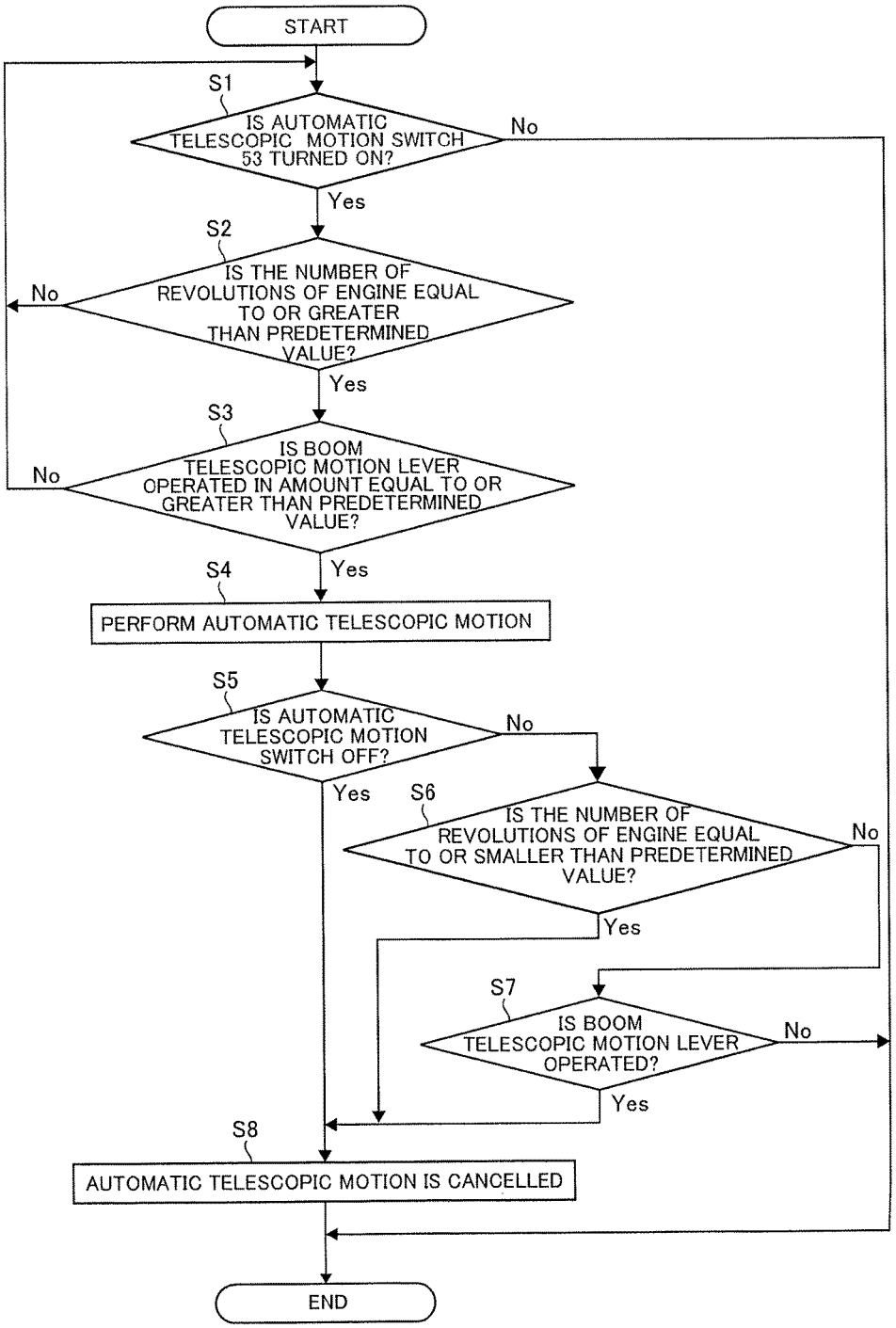
FIG. 6 is a flowchart showing a process for automatic telescopic motion.

Moreover, when an amount of the telescopic motion of the boom 22 is increased by, for example, extending the boom 22 from the minimum length to the maximum length, the mobile crane 1 can perform the automatic telescopic motion by a predetermined operation of the operator. When the operator performs the automatic telescopic motion, the controller 50 performs a process for the automatic telescopic motion as shown in FIG. 6.

<Step S1>

In step S1, the CPU determines whether or not the automatic telescopic motion switch 53 is turned on. When determining that the automatic telescopic motion switch 53 is turned on, the CPU moves the step to step S2. On the other hand, when determining that the automatic telescopic motion switch 53 is not turned on (that is, the automatic telescopic motion switch 53 is turned off), the CPU ends the process for the automatic telescopic motion.

<Step S2>

When determining that the automatic telescopic motion switch 53 is turned on in the step S1, the CPU determines whether or not the number of revolutions of the engine detected by the engine speed sensor 51 is equal to or greater than a first predetermined value R1 in the step S2 (for example, the maximum value of the range for which the accelerator pedal can be operated). When determining that the number of revolutions of the engine is equal to or greater than the first predetermined value R1, the CPU moves the step to step S3. On the other hand, when determining that the number of revolutions of the engine is not equal to or greater than the first predetermined value R1, the CPU moves the step back to the step S1.

<Step S3>

When determining that the number of revolutions of the engine is equal to or greater than the first predetermined value R1 in the step S2, the CPU determines whether or not the boom telescopic motion lever 52 is operated in an amount equal to or greater than a predetermined value (for example, the maximum amount of the operation) in the step S3. When determining that the boom telescopic motion lever 52 is operated in an amount equal to or greater than the predetermined value, the CPU moves the step to step S4. On the other hand, when determining that the boom telescopic motion lever 52 is operated in an amount not equal to or greater than the predetermined value, the CPU moves the step back to the step S1.

<Step S4>

When determining that the boom telescopic motion lever 52 is operated in an amount equal to or greater than the predetermined value in the step S3, the CPU performs the automatic telescopic motion in the step S4. Once the automatic telescopic motion is performed, even though the boom telescopic motion lever 52 is set in the neutral position, the direction and the speed of the telescopic motion of the boom 22 is maintained and the telescopic motion of the boom 22 is continuously performed, as long as the operator operates the accelerator pedal and the number of revolutions of the engine is greater than a second predetermined value R2 described later.

<Step S5>

In step S5, the CPU determines whether or not the automatic telescopic motion switch 53 is turned off. When determining that the automatic telescopic motion switch 53 is turned off, the CPU moves the step to step S8. On the other hand, when determining that the automatic telescopic motion switch 53 is not turned off, the CPU moves the step to step S6 (that is, the automatic telescopic motion switch 53 is turned on).

<Step S6>

When determining that the automatic telescopic motion switch 53 is not turned off in the step S5, the CPU determines whether or not the number of revolutions of the engine is equal to or smaller than the second predetermined value R2 which is smaller than the first predetermined value R1 (for example, R2=R1−150 rpm). When determining that the number of revolutions of the engine is equal to or smaller than the second predetermined value R2, the CPU moves the step to the step S8. On the other hand, when determining that the number of revolutions of the engine is not equal to or smaller than the second predetermined value R2, the CPU moves the step to step S7.

<Step S7>

When determining that the number of revolutions of the engine is not equal to or smaller than the second predetermined value R2 in the step S6, the CPU determines whether or not the boom telescopic motion lever 52 is operated again after the automatic telescopic motion is performed in the step S7. When determining that the boom telescopic motion lever 52 is operated, the CPU moves the step to the step S8. On the other hand, when determining that the boom telescopic motion lever 52 is not operated, the CPU ends the process for the automatic telescopic motion. Here, the operation of the boom telescopic motion lever 52 determined by the CPU may be either the operation to tilt the boom telescopic motion lever 52 forward or the operation to tile the boom telescopic motion lever 52 backward, regardless of the direction of the telescopic motion of the boom 22.

<Step S8>

When determining that the automatic telescopic motion switch 53 is turned off in the step S5, when the number of revolutions of the engine is equal to or smaller than the predetermined value R2 in the step S6, or when determining that the boom telescopic motion lever 52 is operated in the step S7, the CPU cancels the automatic telescopic motion in the step S8, and ends the process for the automatic telescopic motion. To be more specific, the CPU cancels the automatic telescopic motion to stop the telescopic motion of the boom 22. In order to stop the telescopic motion of the boom 22, the CPU gradually decreases the valve opening of the first electromagnetic proportional valve 31*d* or the second electromagnetic proportional valve 31*e*. By this means, the spool of the telescopic motion switching valve 31*c* is gradually moved to the neutral position, so that boom 2 slowly stops.

As described above, according to the present embodiment, in the state in which the automatic telescopic motion switch 53 is turned on, when the engine speed sensor 51 detects the number of revolutions of the engine which is equal to or greater than the first predetermined value R1 and the operation is inputted to the boom telescopic motion lever 52 to increase the speed of the telescopic motion of the boom 22 to a value equal to or greater than the predetermined value, the automatic boom telescopic motion apparatus for a working machine performs the automatic telescopic motion to continue the telescopic motion of the boom 22 without inputting the operation to perform the telescopic motion of the boom 22 by the boom telescopic motion lever 52. By this means, when an amount of the telescopic motion of the boom 22 is increased by, for example, extending the boom 22 from the minimum length to the maximum length, it is possible to continue the telescopic motion of the boom 22 without the operation of the boom telescopic motion lever 52. Therefore, it is possible to decrease in strain and fatigue in the arms or hands of the operator when the amount of the telescopic motion of the boom 22 is increased.

In addition, when the number of revolutions of the engine is decreased from the first predetermined value to the second predetermined value, the automatic telescopic motion is cancelled. By this means, it is possible to cancel the automatic telescopic motion of the boom 22 by a simple operation. Therefore, when the telescopic motion of the boom 22 needs to be stopped in an emergency situation, it is possible to certainly and easily stop the telescopic motion of the boom 22, and consequently to improve the safety of the crane operation.

In addition, when an operation is inputted to the boom telescopic motion lever 52, the automatic telescopic motion is cancelled. By this means, it is possible to cancel the automatic telescopic motion of the boom 22 by a simple operation. Therefore, when the telescopic motion of the boom 22 needs to be stopped in an emergency situation, it is possible to certainly and easily stop the telescopic motion of the boom 22, and consequently to improve the safety of the crane operation.

Moreover, the automatic telescopic motion is cancelled when the automatic telescopic motion switch 53 is turned off. By this means, it is possible to cancel the automatic telescopic motion of the boom 22 by a simple operation. Therefore, when the telescopic motion of the boom 22 needs to be stopped in an emergency situation, it is possible to certainly and easily stop the telescopic motion of the boom 22, and consequently to improve the safety of the crane operation.

Moreover, when the automatic telescopic motion is cancelled, the speed of the telescopic motion of the boom 22 is gradually decreased to stop the telescopic motion of the boom 22. By this means, it is possible to prevent vibrations due to the sudden stop of the telescopic motion of the boom 22, and therefore to improve the safety of the crane operation.

Furthermore, one telescopic cylinder 31 including the piston rod 31*b* and the cylinder tube 31*b* is provided. The telescopic cylinder 31 allows the boom 22 to perform the telescopic motion by switching between the connection and disconnection of the cylinder tube 31*a* with the boom members other than the bottom boom member 22*a*. By this means, the boom 22 that performs the telescopic motion by one telescopic cylinder 31 needs a longer time for the telescopic motion than the boom that performs the telescopic motion by a plurality of cylinders. However, it is possible to decrease in strain and fatigue in the arms or hands of the operator.

Here, with the above-described embodiment, a configuration has been described where the automatic boom telescopic motion apparatus according to the present invention is applied to a mobile crane. However, it is by no means limiting. The automatic boom telescopic motion apparatus according to the present invention is applicable to a working machine such as an aerial work platform, in addition to the mobile crane, as long as it is provided with a telescopic boom.

In addition, with the above-described embodiment, a configuration has been described where the telescopic motion of the boom 22 can be performed by one telescopic cylinder 31. However, it is by no means limiting. The present invention is applicable to a working machine having a boom which performs the telescopic motion by two or more hydraulic cylinders.

Moreover, with the above-described embodiment, a configuration has been described where the driving source of the telescopic cylinder 31 is the engine for running the vehicle 10. However, it is by no means limiting. As the driving source of the telescopic cylinder 31, for example, an electric motor is applicable, in addition to the engine.

Moreover, with the above-described embodiment, a configuration has been described where the automatic telescopic motion is performed by detecting the number of revolutions of the engine. However, it is by no means limiting, but the automatic telescopic motion is performed by detecting the amount of the operation of the accelerator pedal, instead of the number of revolutions of the engine.

Furthermore, with the above-described embodiment, a configuration has been described where the accelerator pedal which is operated by the foot of the operator is used as means for adjusting the number of revolutions of the engine. However, it is by no means limiting, but, as means for adjusting the number of revolutions of the engine, an accelerator lever which is operated by the hands of the operator is applicable.

Furthermore, with the above-described embodiment, a configuration has been described where the boom telescopic motion lever 52 that can input the direction and the speed of the telescopic motion of the boom 22 at a time is used as the boom telescopic motion input part. However, it is by no means limiting. The direction and the speed of the telescopic motion of the boom 22 may be inputted by different operation means, as long as it is possible to input the direction and the speed of the telescopic motion of the boom 22.

Furthermore, with the above-described embodiment, a configuration has been described where the automatic telescopic motion switch 53 is a bottom switch that can switch between on and off by the pushing operation. However, it is by no means limiting. For example, a toggle switch or a rotary switch is applicable as the automatic telescopic motion switch as long as it is possible to switch between on and off.

REFERENCE SIGNS LIST

20 crane apparatus, 22 boom, 22*a* bottom boom member, 22*b* second boom member, 22*c* third boom member, 22*d* forth boom member, 22*e* fifth boom member, 22*f* top boom member, 30 boom telescopic motion mechanism, 31 telescopic cylinder 31*c* telescopic motion switching valve, 31*d* first electromagnetic proportional valve, 31*e* second electromagnetic proportional valve, 32 cylinder-to-boom connection mechanism, 32*b* cylinder-to-boom connection switching cylinder, 32*d* cylinder-to-boom connection switching valve, 33 boom member connection mechanism, 34 boom member disconnection mechanism, 34*b* boom member connection switching cylinder, 34*c* boom member connection switching valve, 50 controller, 51 engine speed sensor, 52 boom telescopic motion lever, 53 automatic telescopic motion switch

The invention claimed is:

1. An automatic boom telescopic motion apparatus for a working machine, comprising:

a boom including a plurality of boom members, the boom performing telescopic motion by shifting next boom members in front of respective ones with respect to the boom members other than a top boom member;

a telescopic cylinder configured to allow the boom to perform the telescopic motion;

a driving source configured to drive the telescopic cylinder;

an output detection part configured to detect an output of driving force supplied from the driving source;

a boom telescopic motion input part configured to input a direction of the telescopic motion of the boom and also input an operation to adjust a speed of the telescopic motion of the boom;

an on/off operation part configured to be able to switch between on and off by a predetermined operation; and an automatic telescopic motion part configured to continue the telescopic motion of the boom without inputting an operation to perform the telescopic motion of the boom by the boom telescopic motion input part, in a state in which the on/off operation part is turned on, when the output detection part detects an output which is equal to or greater than a predetermined value and an operation is inputted to the boom telescopic motion input part to increase the speed of the telescopic motion of the boom to a value equal to or higher than the predetermined value.

2. The automatic boom telescopic motion apparatus according to claim 1, wherein the telescopic motion of the boom by the automatic telescopic motion part is cancelled when the output of the driving source is reduced in a predetermined amount.

3. The automatic boom telescopic motion apparatus according to claim 1, wherein the telescopic motion of the boom by the automatic telescopic motion part is cancelled when an operation is inputted to the boom telescopic motion input part again.

4. The automatic boom telescopic motion apparatus according to claim 2, wherein the telescopic motion of the boom by the automatic telescopic motion part is cancelled when an operation is inputted to the boom telescopic motion input part again.

5. The automatic boom telescopic motion apparatus according to claim 1, wherein the telescopic motion of the boom by the automatic telescopic motion part is cancelled when an operation is inputted to the on/off operation part to turn off the on/off operation part.

6. The automatic boom telescopic motion apparatus according to claim 2, wherein the telescopic motion of the boom by the automatic telescopic motion part is cancelled when an operation is inputted to the on/off operation part to turn off the on/off operation part.

7. The automatic boom telescopic motion apparatus according to claim 3, wherein the telescopic motion of the boom by the automatic telescopic motion part is cancelled when an operation is inputted to the on/off operation part to turn off the on/off operation part.

8. The automatic boom telescopic motion apparatus according to claim 4, wherein the telescopic motion of the boom by the automatic telescopic motion part is cancelled when an operation is inputted to the on/off operation part to turn off the on/off operation part.

9. The automatic boom telescopic motion apparatus according to claim 2, further comprising a slow stop part configured to gradually reduce the speed of the telescopic motion of the boom to stop the telescopic motion of the boom when the telescopic motion of the boom by the automatic telescopic motion part is cancelled.

10. The automatic boom telescopic motion apparatus according to claim 3, further comprising a slow stop part configured to gradually reduce the speed of the telescopic motion of the boom to stop the telescopic motion of the boom when the telescopic motion of the boom by the automatic telescopic motion part is cancelled.

11. The automatic boom telescopic motion apparatus according to claim 5, further comprising a slow stop part configured to gradually reduce the speed of the telescopic motion of the boom to stop the telescopic motion of the boom when the telescopic motion of the boom by the automatic telescopic motion part is cancelled.

12. The automatic boom telescopic motion apparatus according to claim 1, further comprising one telescopic cylinder having a piston rod and a cylinder tube and configured to allow the boom to perform the telescopic motion by switching between connection and disconnection of one of the piston rod and the cylinder tube with the boom members other than a bottom boom member while connecting the other of the piston rod and the cylinder tube to the bottom boom member.

* * * * *